US007465132B2

(12) United States Patent
Gipson

(10) Patent No.: US 7,465,132 B2
(45) Date of Patent: Dec. 16, 2008

(54) VACUUM DUST COLLECTOR BRUSH ASSEMBLY

(76) Inventor: Dale Gipson, 7406 W. Tapps Hwy. E., Bonney Lake, WA (US) 98390

( * ) Notice: Subject to any disclaimer, the term of this patent is extended or adjusted under 35 U.S.C. 154(b) by 0 days.

(21) Appl. No.: 11/891,309

(22) Filed: Aug. 8, 2007

(65) Prior Publication Data

US 2008/0034522 A1 Feb. 14, 2008

Related U.S. Application Data

(60) Provisional application No. 60/836,491, filed on Aug. 8, 2006.

(51) Int. Cl.
*B23C 9/00* (2006.01)

(52) U.S. Cl. ..... 409/137

(58) Field of Classification Search ..... 409/134, 409/137; 408/241 G, 58, 67, 76; 451/456; 144/252.1; 29/DIG. 86; 15/104.09
See application file for complete search history.

(56) References Cited

U.S. PATENT DOCUMENTS

| | | | | | |
|---|---|---|---|---|---|
| 3,837,383 | A * | 9/1974 | Ko | 144/251.2 |
| 4,340,326 | A * | 7/1982 | Buonauro et al. | 409/134 |
| 4,750,536 | A * | 6/1988 | Grisley | 144/251.3 |
| 4,915,550 | A * | 4/1990 | Arai et al. | 409/137 |
| 4,986,703 | A * | 1/1991 | Hampl et al. | 409/131 |
| 5,090,847 | A * | 2/1992 | Gelston, II | 409/137 |
| 5,527,207 | A * | 6/1996 | Azar et al. | 451/344 |
| 5,544,986 | A * | 8/1996 | Kudo et al. | 409/137 |
| 5,709,597 | A * | 1/1998 | Sarantitis | 451/456 |
| 5,848,859 | A * | 12/1998 | Clark et al. | 408/67 |
| 5,931,072 | A * | 8/1999 | Shibata | 451/456 |
| 5,988,954 | A * | 11/1999 | Gaskin et al. | 409/137 |
| 6,079,078 | A * | 6/2000 | Byington | 15/339 |
| 6,443,676 | B1 * | 9/2002 | Kopras | 409/182 |
| 6,470,778 | B1 * | 10/2002 | Kaye et al. | 451/456 |
| 6,827,640 | B2 * | 12/2004 | Bures et al. | 451/456 |
| 7,178,217 | B2 * | 2/2007 | Barnett | 409/137 |
| 7,214,013 | B2 * | 5/2007 | Ferrari et al. | 409/137 |
| 7,296,603 | B2 * | 11/2007 | Thomas | 144/154.5 |
| 7,299,838 | B2 * | 11/2007 | Thomas | 144/154.5 |
| 2003/0077132 | A1 * | 4/2003 | Martinez et al. | 408/1 R |
| 2003/0220060 | A1 * | 11/2003 | Bures et al. | 451/456 |
| 2005/0079809 | A1 * | 4/2005 | Zayat et al. | 451/456 |
| 2006/0019585 | A1 * | 1/2006 | Zayat et al. | 451/344 |

* cited by examiner

*Primary Examiner*—Dana Ross
(74) *Attorney, Agent, or Firm*—Dean A. Craine

(57) ABSTRACT

A dust collector brush assembly capable of being selectively attached to a CNC machine that allows dust and debris to be easily removed from the work site. The brush assembly includes two clam shell half-bodies pivotally connected together along one edge by a main hinge. Each half-body includes a semi-circular upper portion, an upward extending half-tubular exhaust neck portion, and a semi-circular lower portion. When the half-bodies are closed, the two upper half-portions form an enclosed lower cylindrical body designed to loosely capture a mounting plate fixed to the lower surface of the machine's tool head. When the mounting plate is circular, the cylindrical body is able to rotate 360 degrees. When the half-bodies are closed, the two exhaust necks are joined together to form a diagonally aligned exhaust tube. A vacuum hose may then be extended over the upper edge of the exhaust tube to hold the two half-bodies together in a close position on the mounting plate. A circular brush is then attached to the cylindrical body.

7 Claims, 10 Drawing Sheets

VACUUM DUST COLLECTOR BRUSH ASSEMBLY

This is a utility patent application which claims benefit of U.S. Provisional Application No. 60/836,491 filed on Aug. 8, 2006.

BACKGROUND OF THE INVENTION

1. Field of the Invention

This invention pertains to dust collecting brushes and more particularly to dust collecting brushes that are capable of being attached to a CNC mill or router.

2. Description of the Related Art

CNC mills and routers are very popular machines. Such machines typically use a carousel-type tool changer that allows the machine's cutting tool to be easily exchanged. Unfortunately, there is limited space around the changer for viewing and monitoring the work piece when using the machine.

Visibility of the work piece and the cutting tool is especially difficult when making deep cuts that produce large amounts of dust and debris. In order the see the work piece and cutting tool, the operator must stop the machine and remove the dust and debris with a vacuum or brush.

What is needed is a dust collector brush assembly that can be easily attached to the CNC mill or router, that does not interfere with the normal operation of the machine, can be easily attached to a vacuum, and can be used to continuously remove dust and debris.

SUMMARY OF THE INVENTION

It is an object of the present invention to provide a dust collector brush assembly that easily attaches to the head of a CNC mill or router.

It is another object of the present invention to provide such an assembly that does not interfere with the normal operation of the carousel-type tool changer commonly used on CNC mills or routers.

It is another object of the present invention to provide such an assembly that does not require hand tools for attaching and detaching the assembly to the machine.

These and other objects are met by the brush assembly disclosed herein that includes two clam shell half-bodies pivotally connected together along one edge. Each half-body includes a lower half-cylindrical portion with an integrally attached, lateral and upward extending half-tubular exhaust neck portion. When the half-bodies are closed, the two half-cylindrical portions form a cylindrical body that loosely captures a flat mounting plate fixed to the lower surface of the machine's tool head. The assembly is able to rotate 360 degrees when the cylindrical body is enclosed around the mounting plate.

When the cylindrical body is closed to capture the mounting plate, the two half-tubular exhaust neck portions are joined together to form a lateral, upward extending exhaust tube. The end of a vacuum hose may then be extended over the upper edge of the exhaust tube to tightly hold the two exhaust neck portions together and to help hold the cylindrical body on the mounting plate. If necessary, an optional adapter may be used to attach a non-compatible vacuum hose over the two closed exhaust neck portions.

Formed on the lower edge of the half-cylindrical portion of each half-body is a recessed, semi-circular recessed groove and lower receiving lip. When the half-bodies are closed, the two recessed grooves and the two receiving lips are aligned and are able to engage the upper ring located on the upper edge of a circular brush positioned under the cylindrical body.

DESCRIPTION OF THE PREFERRED EMBODIMENT(S)

There is shown in the accompanying FIGS. 1-14 a dust collector brush assembly 10 for a CNC milling machine. The assembly 10 is designed to attach to one of the two types of mounting plates commonly used on the CNC machine. In one embodiment, the assembly 10 can be selectively rotated so that it does not interfere with operation of the machine or the operator's vision.

Figure 1:
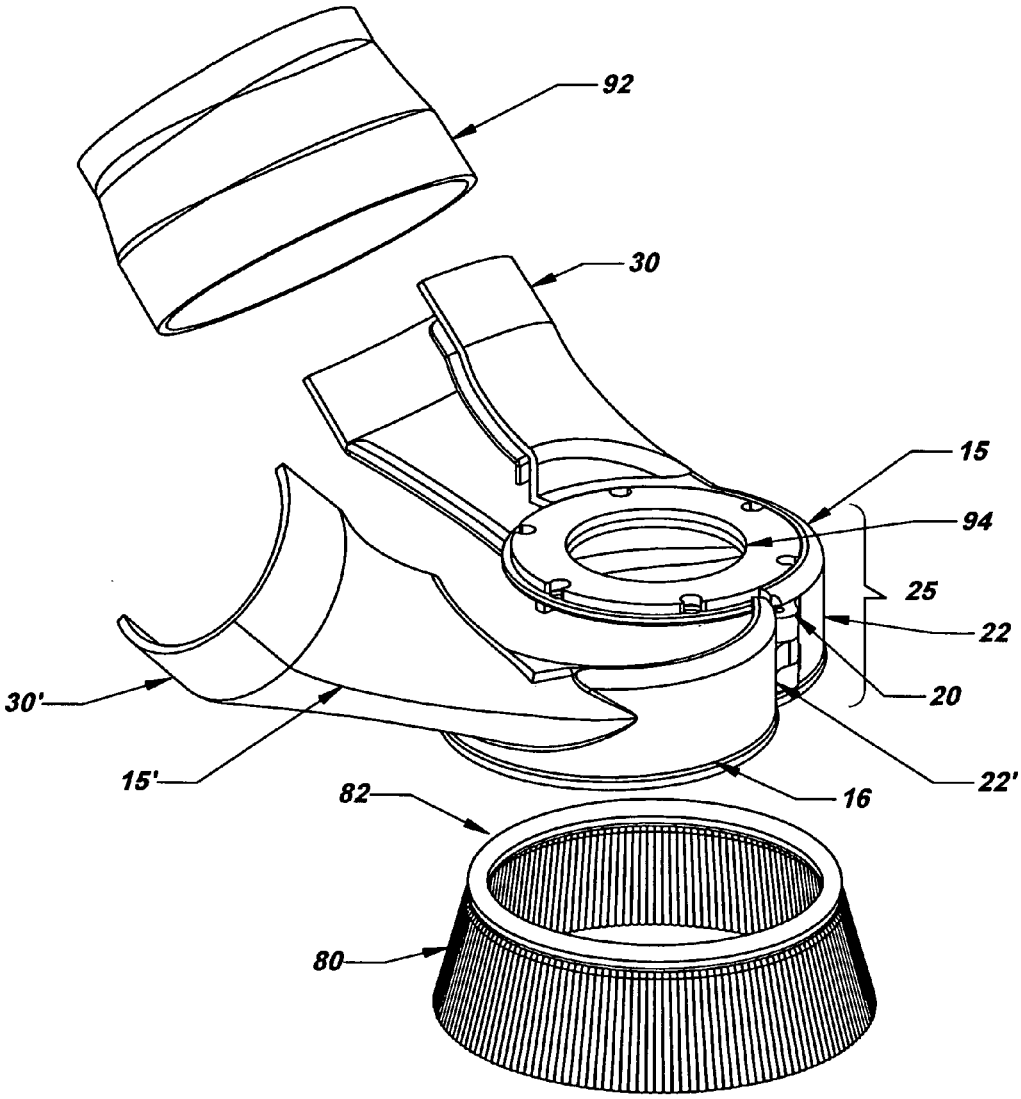
FIG. 1 is an exploded perspective view of the dust collector assembly.

As shown in FIG. 1, the assembly 10 includes two clam shell half-bodies 15, 15' pivotally connected together along one edge by a main hinge 20. Each half-body 15, 15' includes a half-cylindrical portion 22, 22' with an upward extending half tubular exhaust neck portion 30, 30', respectively, integrally formed thereon. When the half-bodies, 15, 15' are closed, the two half-cylindrical portions 22, 22' form an enclosed cylindrical body 25 designed to loosely capture the mounting plate 94 affixed to the lower surface of the machine's tool head 100 (see FIGS. 12-14).

When the half-bodies 15, 15' are closed, the two exhaust neck portions 30, 30' are joined together to form an exhaust tube 35 as shown in FIGS. 4-7. A vacuum hose 92 may then be extended over the upper edge of the two exhaust neck portions 30, 30' to hold them together in a closed position to form the exhaust tube 35. If necessary, an optional adapter 70 (see FIGS. 3-6) may be used to attach a non-compatible vacuum hose 92 to the end of the exhaust tube 35.

Figure 2:
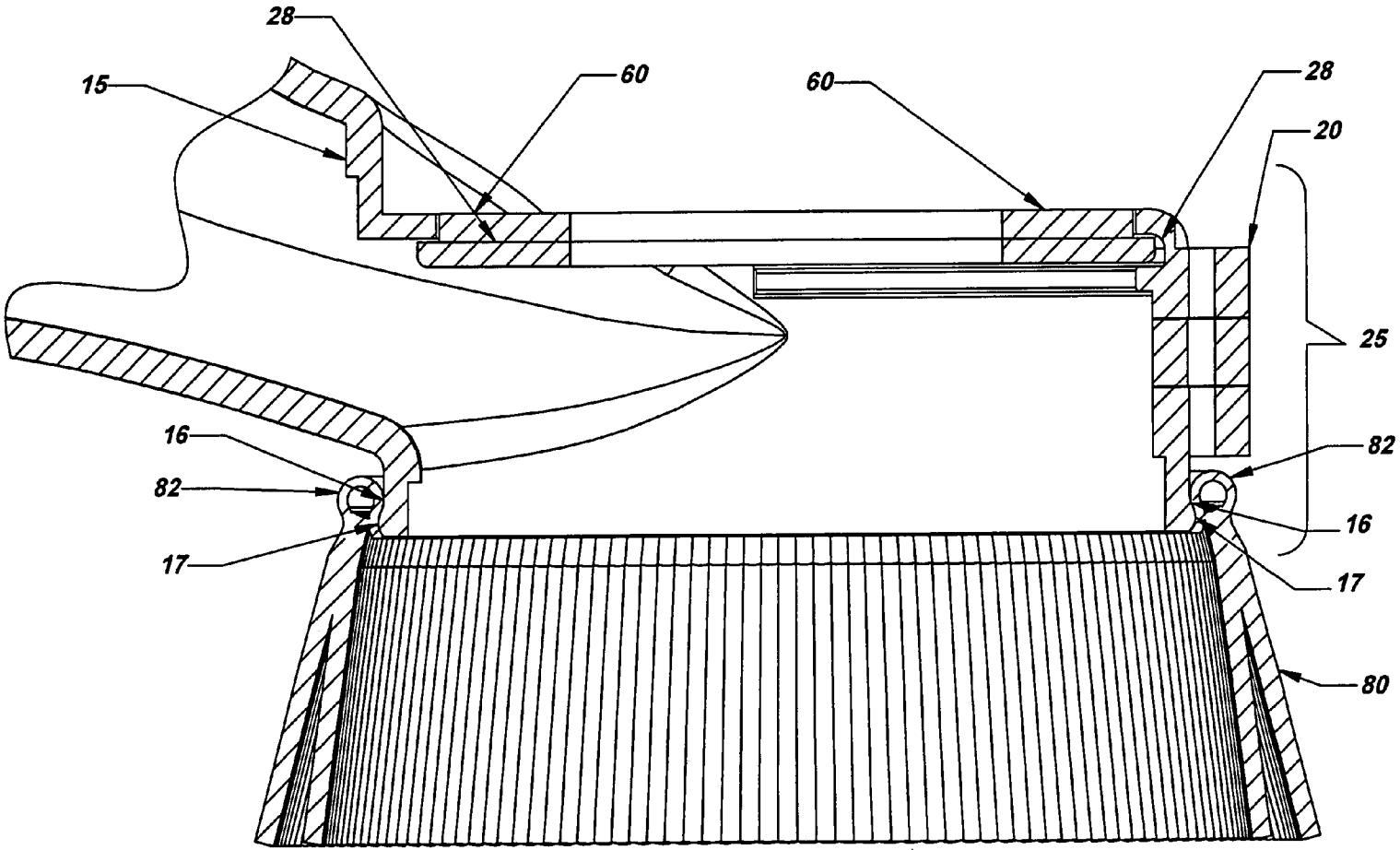
FIG. 2 is a sectional side elevational view of the dust collector assembly shown attached to the circular mounting plate.
Figure 4:
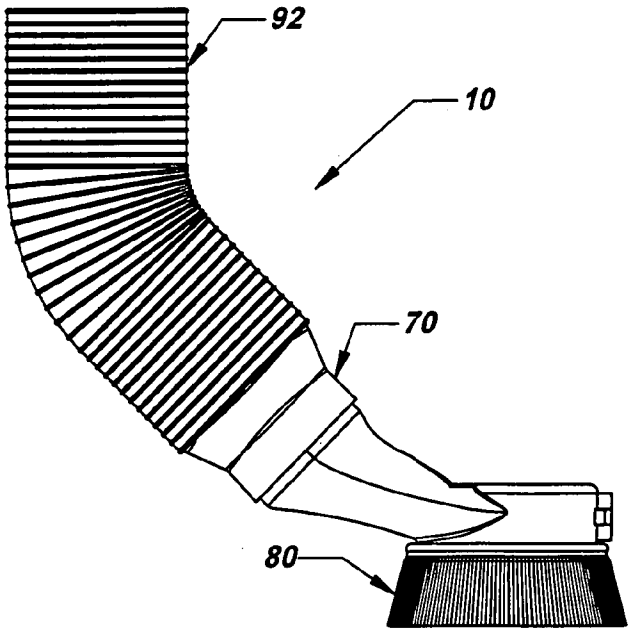
FIG. 4 is a left side elevation of the dust collector assembly.
Figure 3:
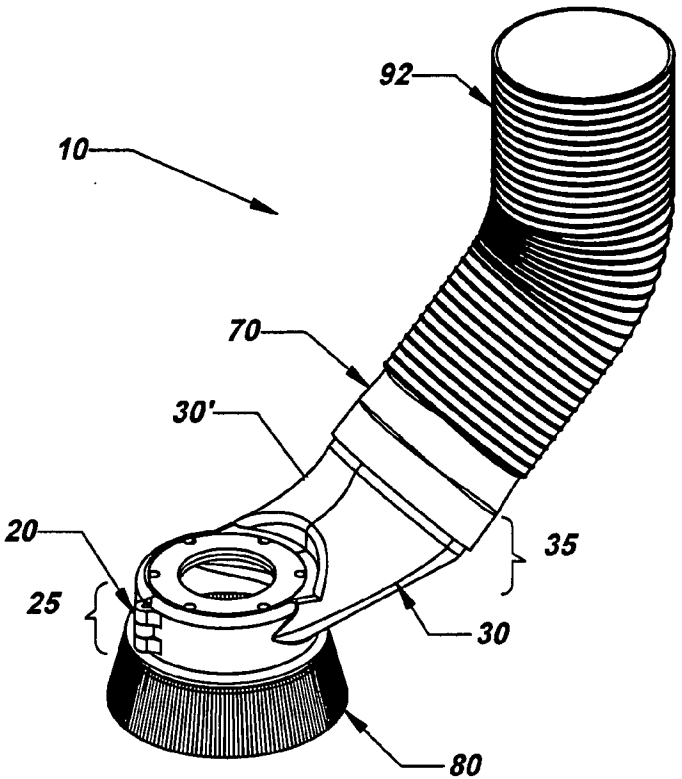
FIG. 3 is a perspective view of the dust collector assembly.
Figure 6:
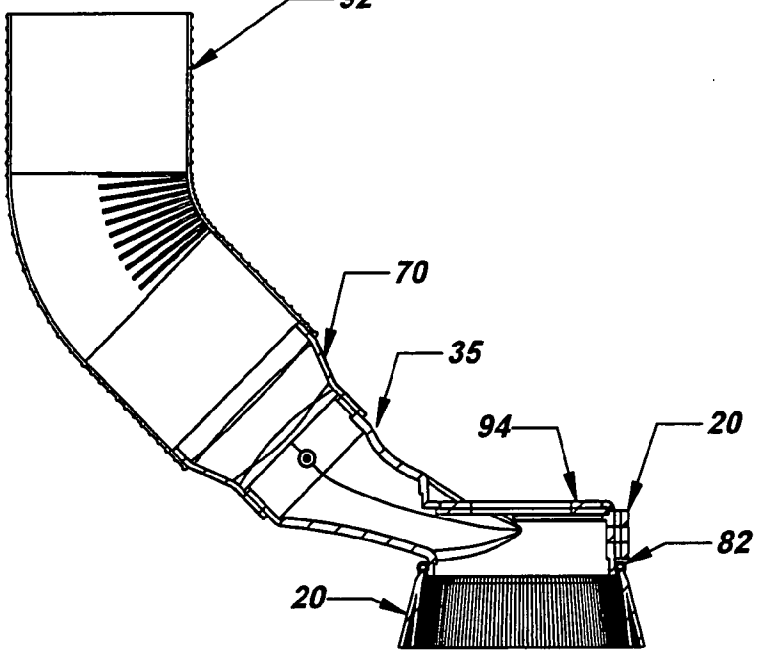
FIG. 6 is a sectional left side elevational view of the dust collector assembly as shown along line 6-6 in FIG. 5.
Figure 5:
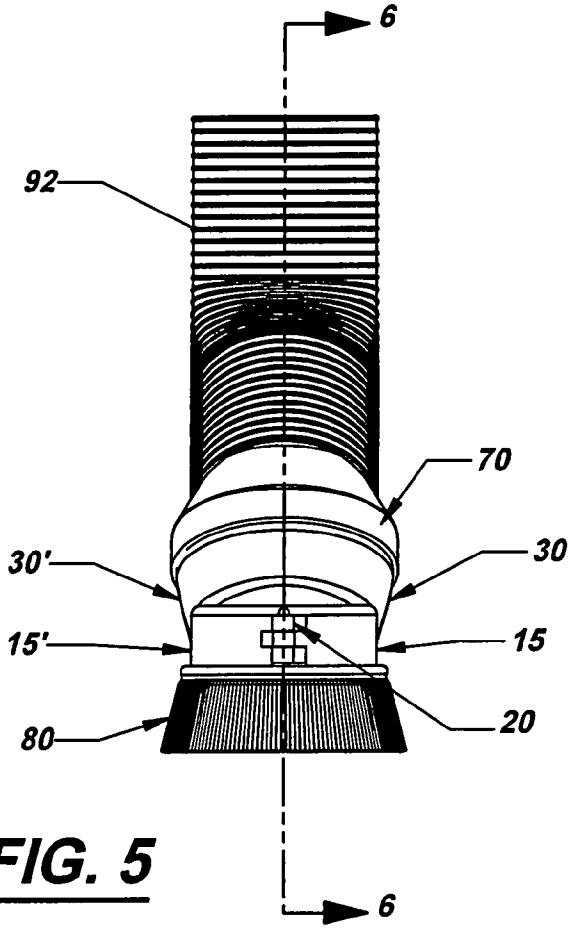
FIG. 5 is a front elevation view of the dust collector assembly.
Figure 8:
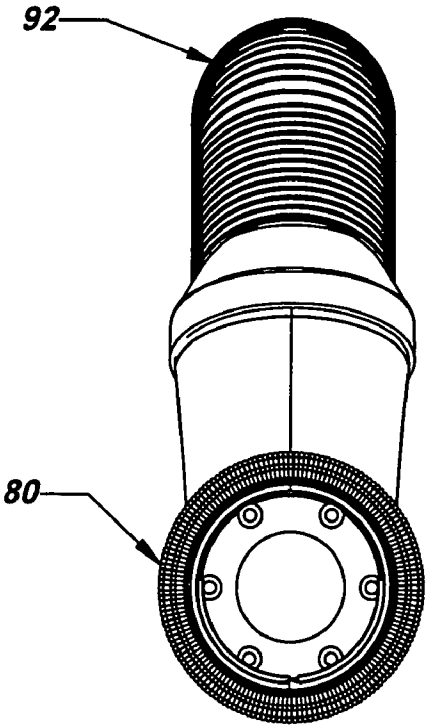
FIG. 8 is a bottom plan view of the dust collector assembly.
Figure 7:
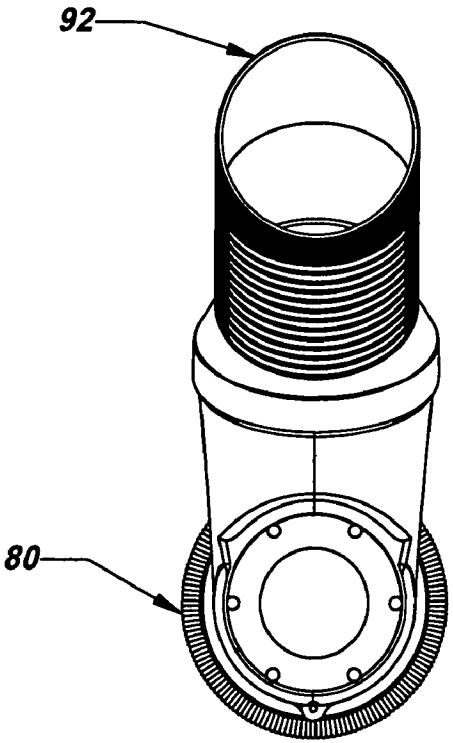
FIG. 7 is a top plan view of the dust collector assembly.

As shown in FIG. 2, formed on the lower edge of each half-body (half-body 15 shown) is a recessed groove 16 and a lower circular receiving lip 17, respectively. The circular receiving lip 17 is designed to snap fit into the center void area formed on a circular brush 80. The upper ring 82 on a circular brush 80 is captured in the recessed groove 16. The upper ring 82 is biased inward thereby allowing the upper ring 82 to snap fit into the recessed groove 16 and around the lip 17.

Figure 9:
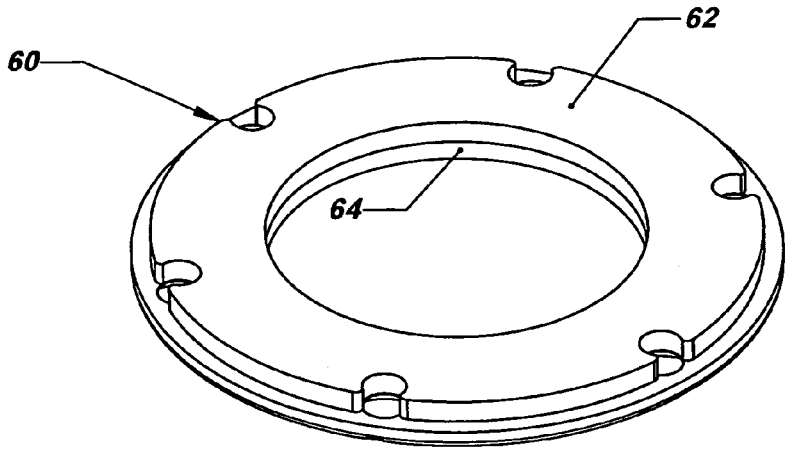
PRIOR ART FIG. 9
FIG. 9 is a perspective view of a circular mounting plat commonly used in a CNC machine.
Figure 10:
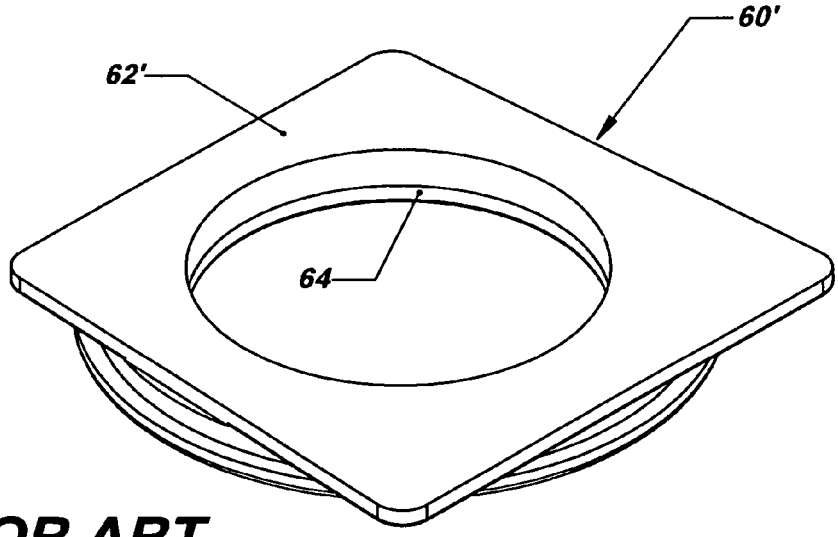
PRIOR ART FIG. 10
FIG. 10 is a perspective view of a square mounting plate commonly used on a CNC machine.
Figure 11:
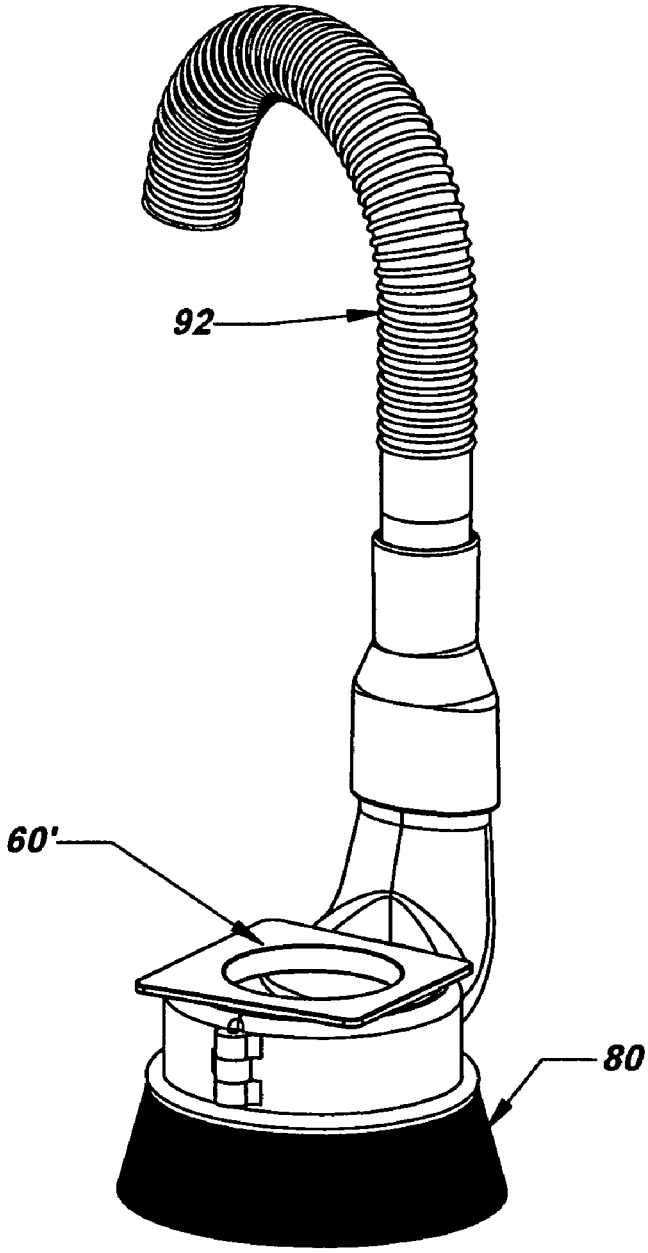
FIG. 11 is a perspective view of the dust collector assembly shown attached to a square mounting plate.

As mentioned above, there are two types of mounting plates 60, 60' commonly used with a CNC machine which are more clearly shown in FIGS. 9 and 10. Mounting bolts (not shown) attached to the tool head 100 extend through the mounting plate 60, 60' to hold it on the tool head 100. In the preferred embodiment, the first circular mounting plate 60 composed of two concentric rings 62, 64 that are integrally stacked vertically. The second mounting plate 60', includes a square top plate 62 and the lower ring 64' is circular. In both mounting plates 60, 60' the lower ring 64, 64' fits inside a circular cut-out slot 28 formed on the inside surface of the half-bodies 15, 15' (see FIG. 2).

Figure 12:
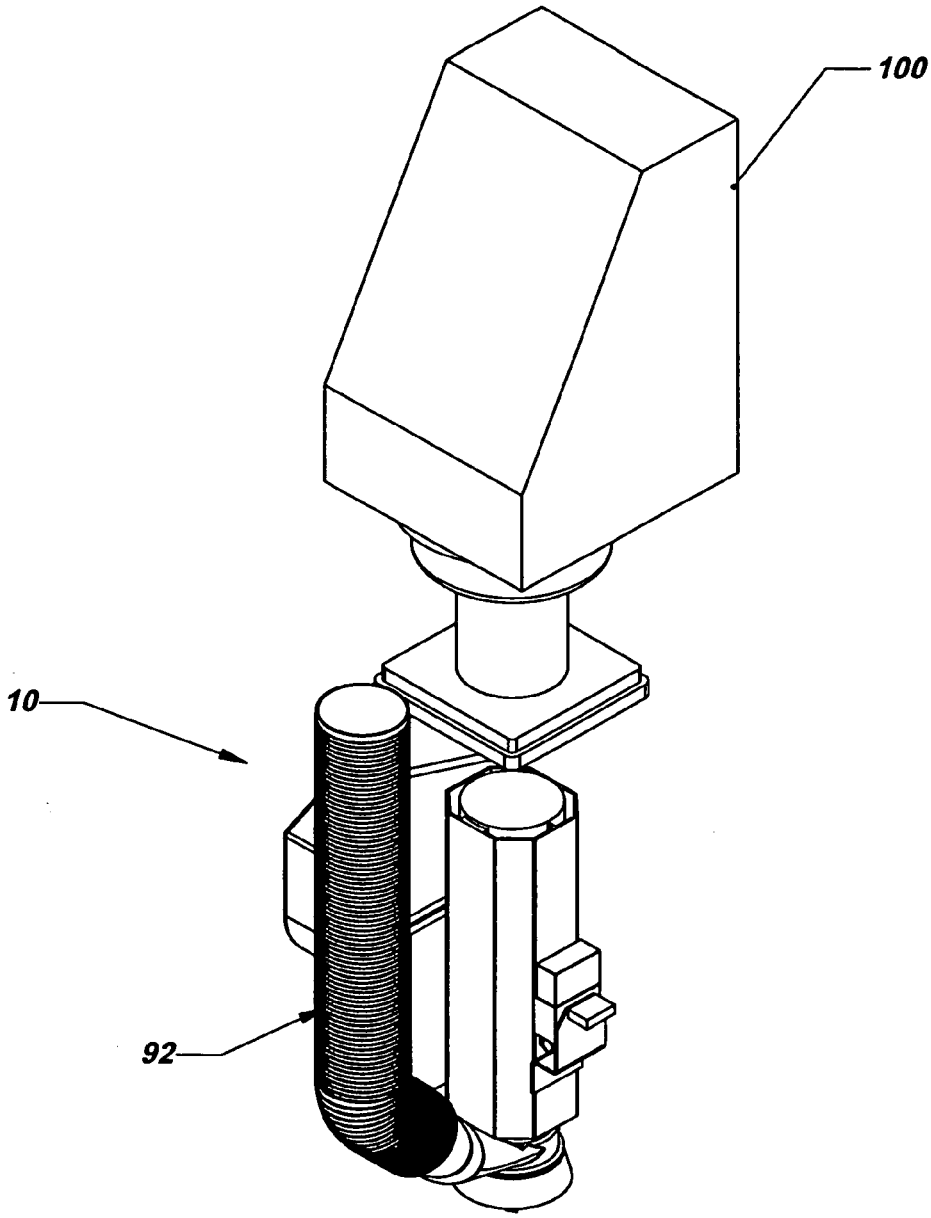
FIG. 12 is a perspective view of a vacuum dust collector assembly attached to a standard spindle used on a CNC machine shown rotated so that exhaust tube is in a forward position.
Figure 13:
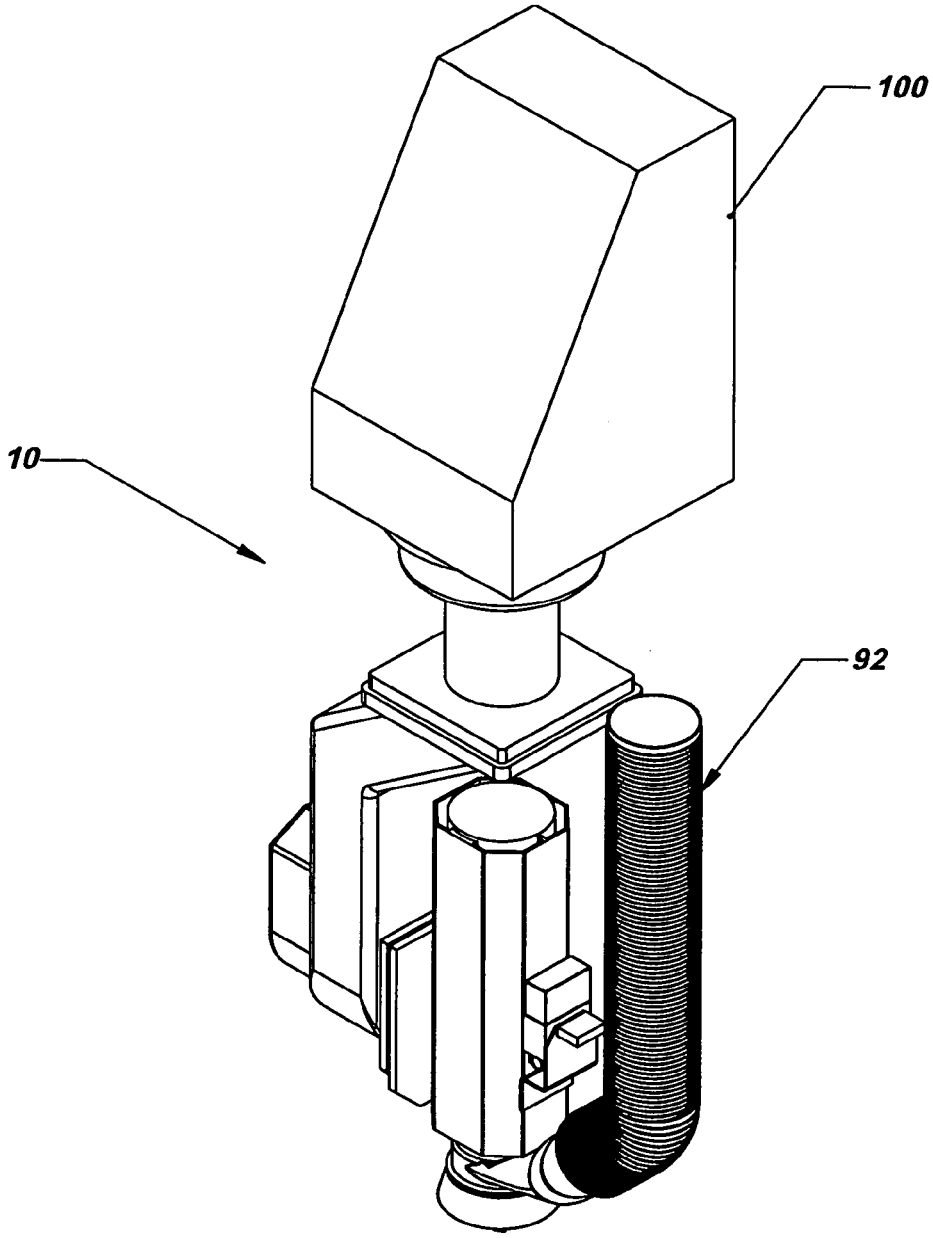
FIG. 13 is a perspective view of the dust collector assembly attached to a standard spindle shown rotated 90 degrees in a counter-clockwise direction.
Figure 14:
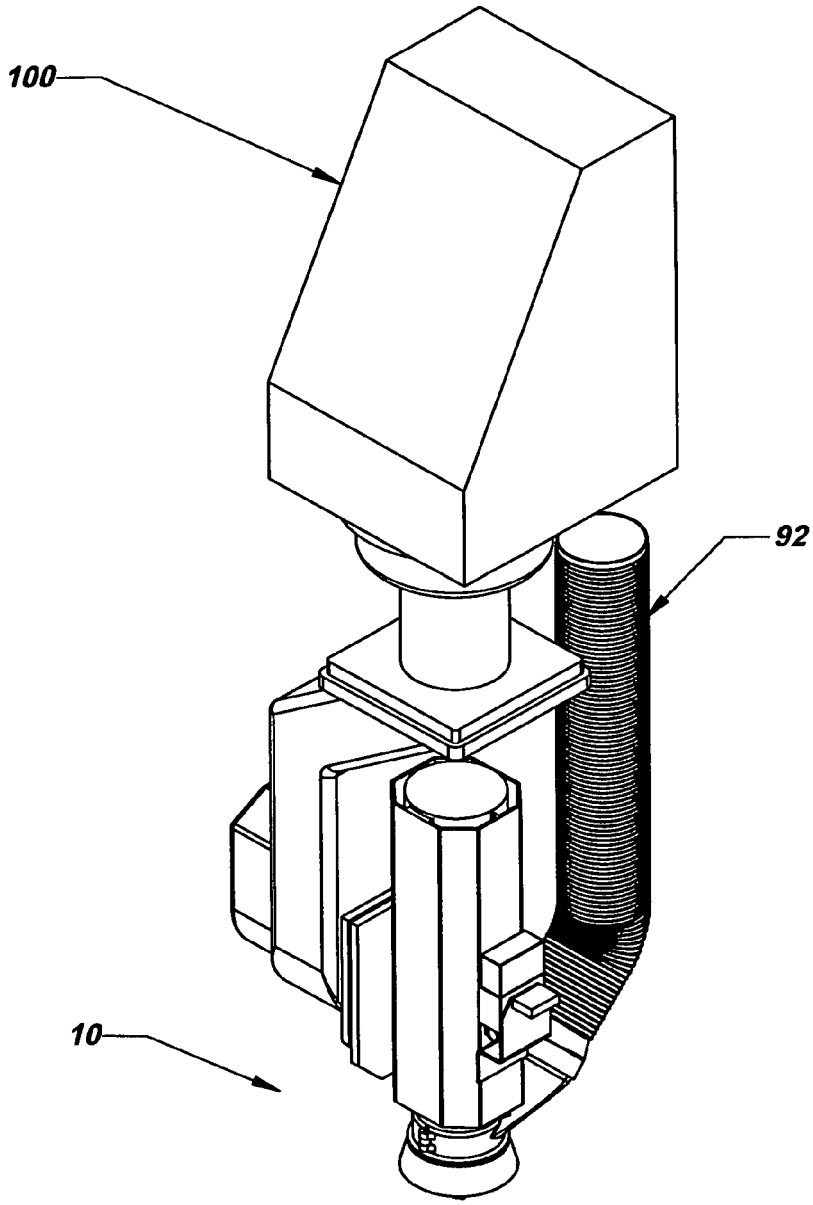
FIG. 14 is a perspective view of the dust collector assembly shown in FIG. 12 showing the exhaust tube rotated 180 degrees in a counter-clockwise direction.

The user first mounts on the mounting plate 60 or 60' to the bottom of the tool head 100, centered on the tool chuck, via bolts or other mechanism. The user then opens the body 25, and slides one half body 15 onto the lower ring 64 or 64' on the mounting plate 60, 60', then closes the second half body 15' together. The user then slides the optional adaptor 70 (if necessary) onto the end of the exhaust tube 35, capturing the two exhaust neck portions 30, 30'. The two half-cylindrical portion 22, 22' are then closed and form the cylindrical body 25. The user may then attach the circular brush 80 onto the bottom of the cylindrical body 25. The assembly 10 may now be selectively rotated, in a clockwise or counter-clockwise direction as shown in FIGS. 12-14.

In summary, the assembly 10 is able to easily and quickly attach to a mounting plate 60 or 60' attached to the tool head 100 on a CNC machine. Because the assembly 10 can freely rotate 360 degrees around the tool head 100, the assembly 10 can be easily rotated in a clockwise or counter-clockwise direction for greater viewing and access to the cutting tools. The orientation of the exhaust tube 35 formed when the two-half exhaust neck portions 30, 30' are closed also provides minimal visual and mechanical interference. Also, a circular brush 80 can be easily attached or detached from the assembly 10.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A dust collector brush assembly for a CNC machine that includes a tool head, said assembly comprises:

a. a flat mounting plate capable of being attached to said tool head, said mounted plate includes a flat, lower circular ring;

b. two clam shell half-bodies pivotally connected together, each said half-body includes a half-cylindrical portion and a half-tubular, laterally extending neck portion which forms an enclosed, hollow cylindrical body and a laterally extending exhaust tube, respectively, when said half-bodies are closed, each said half-body includes an inside curve slot which forms an upper circular slot formed on the inside surface of said cylindrical body that receives said circular ring on said mounting plate when said cylindrical body-is longitudinally aligned under said mounting plate thereby holding said cylindrical body on said mounting plate and allowing said cylindrical body to rotate on the tool head; and, c. a vacuum tube connected to said exhaust tube to hold said half-bodies and said neck portions together in a closed position.

2. The dust collector brush assembly, as recited in claim 1, further includes a longitudinally aligned downward extending brush selectively attached to said cylindrical body.

3. The dust collector brush assembly, as recited in claim 2, wherein said brush includes a snap ring that removably attaches said brush to said cylindrical body.

4. The dust collector brush assembly, as recited in claim 1, further including an adaptor disposed between said vacuum tube and said exhaust tube.

5. A dust collector brush assembly for a CNC machine that includes a tool head, said assembly comprises:

a. a flat mounting plate capable of being attached to said tool head, said mounted plate includes a flat, lower circular ring;

b. two clam shell half-bodies pivotally connected along one edge by at least one hinge, each said half-body includes a half-cylindrical portion and a half-tubular exhaust neck portion that extends laterally in a direction opposite said hinge, said half-bodies and said exhaust neck portions form an enclosed, hollow cylindrical body and an exhaust tube, respectively, when said half-bodies are closed, said cylindrical body also includes an upper circular slot formed on the inside surface that receives said circular ring on said mounting plate and is axially aligned under said mounting plate;

c. a vacuum tube connected to said exhaust tube, and;

d. a brush assembly attached to said lower edge of said cylindrical body.

6. The dust collector brush assembly as recited in claim 5, wherein said brush assembly includes a flexible ring and said cylindrical body includes an outer circular groove that enables said flexible ring to snap fit therein to selectively attach said brush assembly to said cylindrical body.

7. The dust collector brush assembly, as recited in claim 5, further including an adaptor disposed between said vacuum tube and said exhaust tube.

* * * * *